US011736881B2

(12) United States Patent
Kasugai

(10) Patent No.: US 11,736,881 B2
(45) Date of Patent: Aug. 22, 2023

(54) ACOUSTIC SIMULATION APPARATUS

(71) Applicant: HAYASHI TELEMPU CORPORATION, Nagoya (JP)

(72) Inventor: Masashi Kasugai, Aichi (JP)

(73) Assignee: HAYASHI TELEMPU CORPORATION, Nagoya (JP)

( * ) Notice: Subject to any disclaimer, the term of this patent is extended or adjusted under 35 U.S.C. 154(b) by 196 days.

(21) Appl. No.: 17/469,880

(22) Filed: Sep. 9, 2021

(65) Prior Publication Data

US 2021/0409889 A1 Dec. 30, 2021

Related U.S. Application Data

(63) Continuation of application No. PCT/JP2020/006854, filed on Feb. 20, 2020.

(30) Foreign Application Priority Data

Mar. 25, 2019 (JP) ..... 2019-056484

(51) Int. Cl.
*H04S 7/00* (2006.01)
*H04S 5/00* (2006.01)
*H04R 1/02* (2006.01)

(52) U.S. Cl.
CPC ..... *H04S 7/30* (2013.01); *H04S 5/005* (2013.01); *H04R 1/02* (2013.01); *H04R 2499/13* (2013.01)

(58) Field of Classification Search
None
See application file for complete search history.

(56) References Cited

U.S. PATENT DOCUMENTS 9,497,561 B1 * 11/2016 Khabbazibasmenj .. H04S 7/305
2017/0251324 A1 * 8/2017 Stelandre ..... H04R 5/04

FOREIGN PATENT DOCUMENTS

JP H09-149491 A 6/1997
JP H11-38979 A 2/1999
JP 2016-220032 A 12/2016

OTHER PUBLICATIONS

International Search Report for PCT/JP2020/006854 dated Apr. 14, 2020.

(Continued)

*Primary Examiner* — Kenny H Truong
(74) *Attorney, Agent, or Firm* — Yokoi & Co., U.S.A.; Toshiyuki Yokoi

(57) ABSTRACT

A virtual reproduction signal generation unit generates a virtual reproduction signal based on a sound pickup signal of a stereophonic sound at a listening position in a compartment, assuming that virtual speakers are respectively located at portions of Np positions in a vehicle, the virtual reproduction signal causing the virtual speakers of the Np positions to reproduce the stereophonic sound. A virtual prediction signal generation unit generates a virtual prediction signal based on the virtual reproduction signal and an information representing a change of acoustic characteristics when at least part of the portions of the Np positions is changed, the virtual prediction signal causing the virtual speakers of the Np positions to output a predicted sound at the listening position. An output signal generation unit generates an output signal based on the virtual prediction signal, the output signal causing speakers of a plurality of positions to output the predicted sound.

4 Claims, 4 Drawing Sheets

(56) References Cited

OTHER PUBLICATIONS

PCT written opinion dated Apr. 14, 2020.
Ryouichi Nishimura, Ambisonics, The journal of the Institute of Image Information and Television Engineers, vol. 68, No. 8, p. 616-620, 2014 (Only the explanation of the figures has been translated into English.).

* cited by examiner

ACOUSTIC SIMULATION APPARATUS

CROSS-REFERENCES TO RELATED APPLICATIONS

This Application claims the benefit of priority and is a Continuation application of the prior International Patent Application No. PCT/JP2020/006854, with an international filing date of Feb. 20, 2020, which designated the United States, and is related to the Japanese Patent Application No. 2019-056484, filed Mar. 25, 2019, the entire disclosures of all applications are expressly incorporated by reference in their entirety herein.

BACKGROUND OF THE INVENTION

1. Field of the Invention

The present invention relates to an acoustic simulation apparatus for simulating a sound in a compartment of a vehicle.

2. Description of Related Art

A computer simulation of the sound in a vehicle compartment has been performed for predicting the sound of the vehicle compartment of an automobile.

In addition, Japanese Unexamined Patent Application Publication No. H9-149491 discloses the technology of reproducing the sound stereophonically. In the above describe technology, sounds are recorded in four directions by microphones arranged respectively on the positions forming vertexes of a regular tetrahedron and stereophonic sound is outputted from speakers arranged respectively on the positions that correspond to vertexes of the regular tetrahedron.

BRIEF SUMMARY OF THE INVENTION

Unfortunately, the technology of predicting the sound in the vehicle compartment stereophonically has not been developed. If the stereophonic sound in the vehicle compartment can be simulated, the sound of the vehicle compartment can be evaluated precisely.

The present invention discloses an acoustic simulation apparatus that is capable of simulating a stereophonic sound in a compartment of a vehicle precisely.

One embodiment of the present invention provides an acoustic simulation apparatus for simulating a sound in a compartment of a vehicle, the acoustic simulation apparatus including:

a virtual reproduction signal generation unit configured to generate a virtual reproduction signal based on a sound pickup signal of a stereophonic sound at a listening position in the compartment, assuming that virtual speakers are respectively located at portions of Np positions which are two or more positions in the vehicle, the virtual reproduction signal causing the virtual speakers of the Np positions to reproduce the stereophonic sound;

a virtual prediction signal generation unit configured to generate a virtual prediction signal based on the virtual reproduction signal and an information representing a change of acoustic characteristics when at least a part of the portions of the Np positions is changed, the virtual prediction signal causing the virtual speakers of the Np positions to output a predicted sound at the listening position; and an output signal generation unit configured to generate an output signal based on the virtual prediction signal, the output signal causing speakers of a plurality of positions to output the predicted sound.

DETAILED DESCRIPTION OF THE INVENTION

Figure 1:
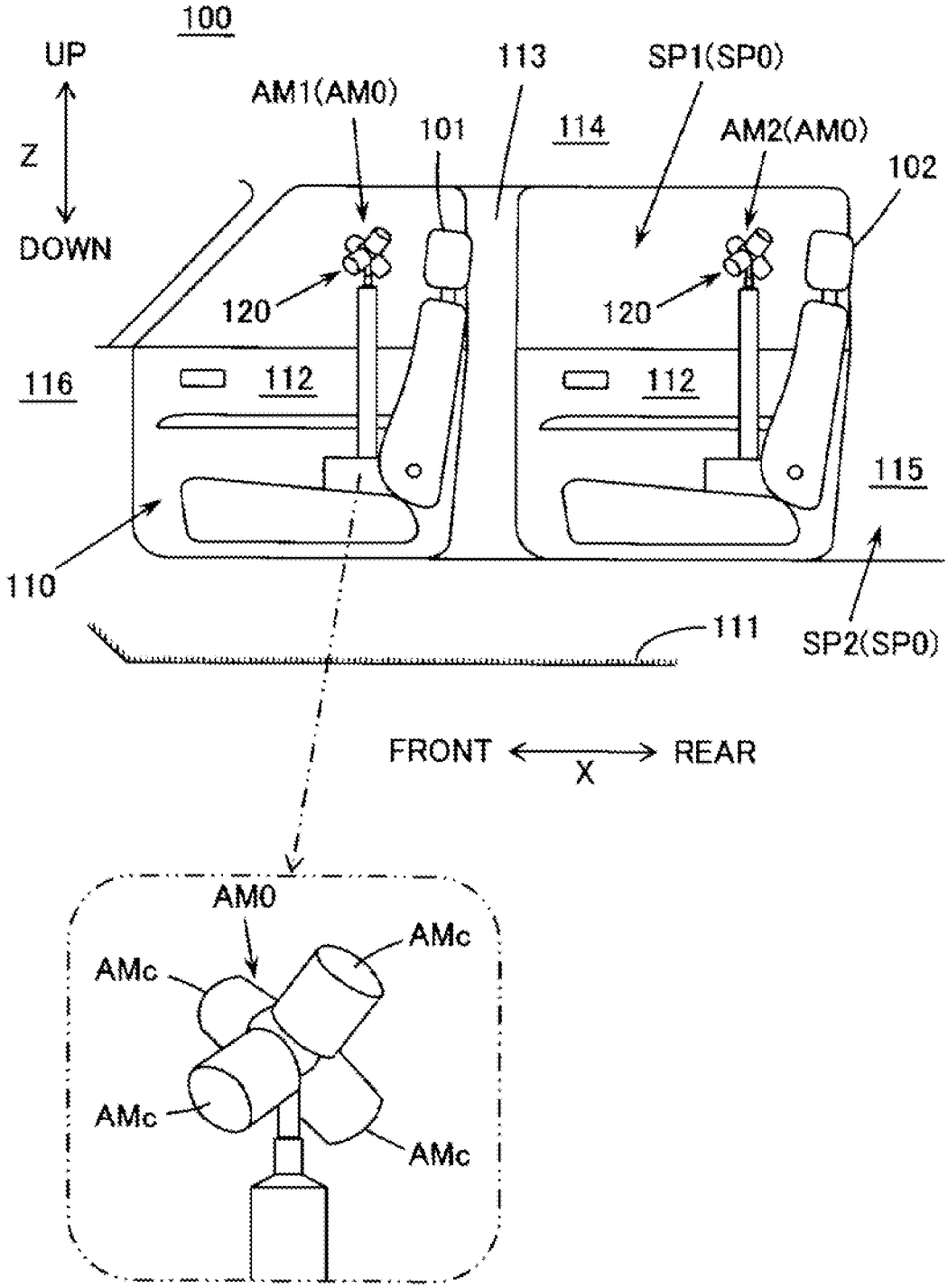
FIG. 1 is a drawing schematically showing an example of an interior of an automobile in which ambisonic microphones are installed in a state that an illustration of a side surface part is omitted.

Hereafter, embodiments of the present invention will be explained. Of course, the below-described embodiments merely exemplify the present invention. All features disclosed in the embodiments are not necessarily essential for the present invention to solve the problems.

(1) Outline of Technology Included in the Present Invention

First, with reference to FIGS. 1 to 4, an outline of the technology included in the present invention will be explained. Note that the drawings of the present application schematically show the examples. Thus, magnification ratios of each of the directions shown in the drawings may be different, and each of the drawings may not fit together. Of course, each element of the present technology is not limited to the concrete examples indicated by the reference letters.

In the present application, the numerical range "Min to Max" means that the range is equal to or more than the minimum value "Min" and is equal to or less than the maximum value "Max."

Embodiment 1

An acoustic simulation apparatus 1 concerning one embodiment of the present technology is the acoustic simulation apparatus 1 for simulating a sound in a compartment SP0 of a vehicle (e.g., an automobile 100) including a virtual reproduction signal generation unit (virtual reproduction signal generator) U1, a virtual prediction signal generation unit (virtual prediction signal generator) U2 and an output signal generation unit (output signal generator) U3. The virtual reproduction signal generation unit U1 generates a virtual reproduction signal SG3 based on a sound pickup signal SG1 of a stereophonic sound at a listening position 120 in the compartment SP0, assuming that virtual speakers VS0 are respectively located at portions of Np positions which are two or more positions in the vehicle (100), the virtual reproduction signal SG3 causing the virtual speakers VS0 of the Np positions to reproduce the stereophonic sound. The virtual prediction signal generation unit U2 generates a virtual prediction signal SG4 based on the virtual reproduction signal SG3 and an information (e.g., acoustic characteristic change information IM1) representing a change of acoustic characteristics when at least a part of the portions of the Np positions is changed, the virtual prediction signal SG4 causing the virtual speakers VS0 of the Np positions to output a prediction sound that is predicted at the listening position 120. The output signal generation unit U3 generates an output signal SG6 based on the virtual prediction signal SG4, the output signal SG6 causing speakers 300 of a plurality of positions to output the prediction sound.

In the above described embodiment 1, the output signal SG6 for outputting the prediction sound is generated in a state that the change of the acoustic characteristics is precisely reflected to the prediction sound when at least a part of the portions of the Np positions is changed. Accordingly, the present embodiment can provide an acoustic simulation apparatus that is capable of simulating the stereophonic sound in the compartment of the vehicle precisely.

Here, a signal means a change of a physical quantity used for expressing the data. The signal is expressed by digital data, for example.

The A-format signal picked up with an ambisonic microphone and other signals can be used as the sound pickup signal.

Assuming that speakers are actually located at the Np positions of the virtual speakers, the virtual reproduction signal means a signal that causes the speakers to reproduce the original stereophonic sound at the listening position.

Assuming that speakers are actually located at the Np positions of the virtual speakers, the virtual prediction signal means a signal that causes the speakers to reproduce the prediction sound at the listening position.

Note that the above described remarks can be also applied to the following embodiments.

Embodiment 2

Figure 3:
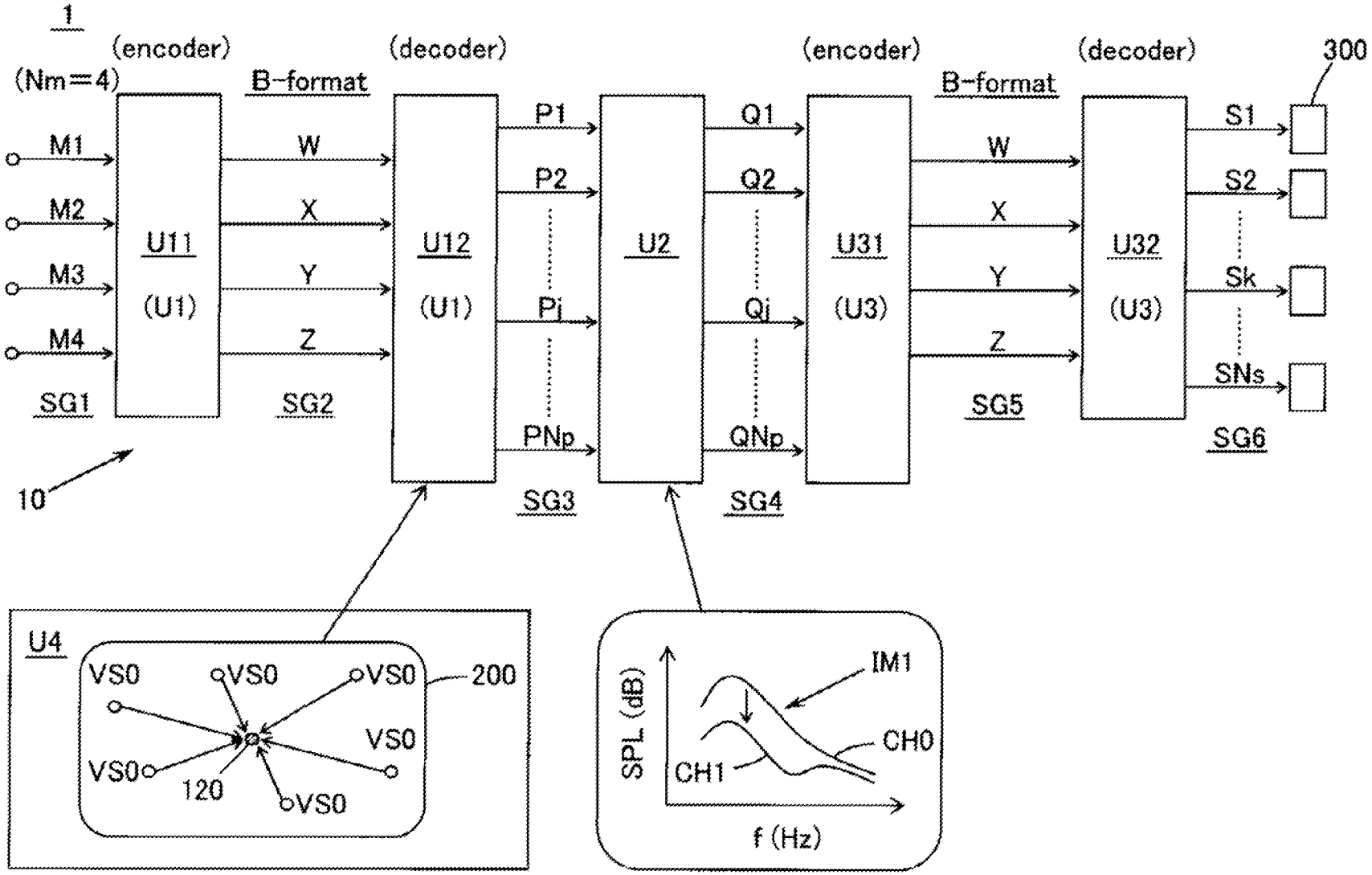
FIG. 3 is a block diagram schematically showing an example of signal processing of the acoustic simulation apparatus.
Figure 4:
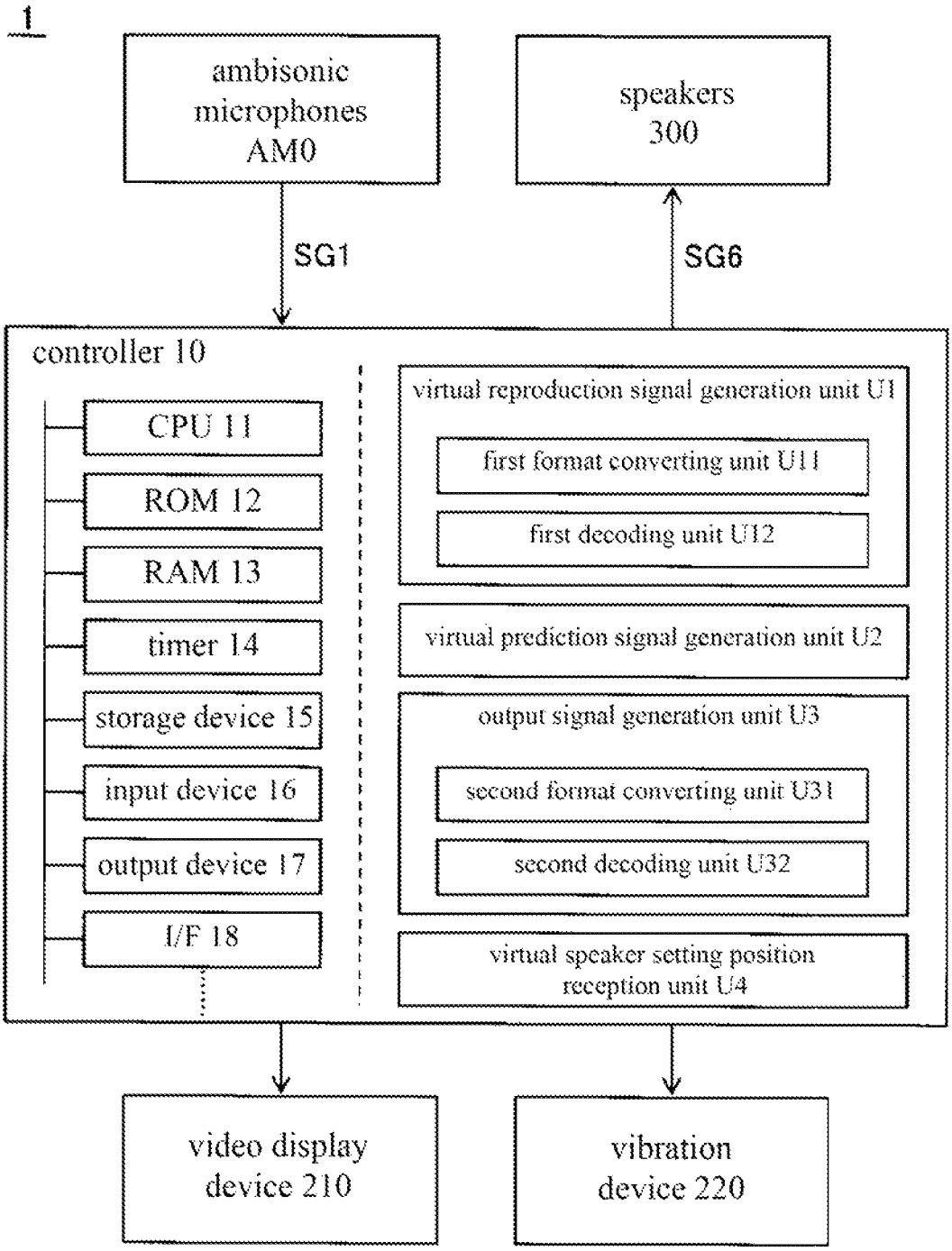
FIG. 4 is a block diagram schematically showing a configuration example of a controller of the acoustic simulation apparatus with a peripheral part.

As illustrated in FIGS. 3 and 4, the virtual reproduction signal generation unit U1 may include a first format converting unit (format converter) U11 configured to convert the sound pickup signal SG1 into a first encoded signal SG2 having a plurality of sound pickup directivity characteristics (e.g., components W, X, Y, Z) and a first decoding unit (decoder) U12 configured to generate the virtual reproduction signal SG3 based on the first encoded signal SG2. The output signal generation unit U3 may include a second format converting unit (format converter) U31 configured to convert the virtual prediction signal SG4 into a second encoded signal SG5 having the plurality of sound pickup directivity characteristics (W, X, Y, Z) and a second decoding unit (decoder) U32 configured to generate the output signal SG6 based on the second encoded signal SG5. Since the plurality of sound pickup directivity characteristics (W, X, Y, Z) of the first encoded signal SG2 are identical to the plurality of sound pickup directivity characteristics (W, X, Y, Z) of the second encoded signal SG5 in the present embodiment, conversion processing of the first format converting unit U11 and conversion processing of the second format converting unit U31 can be simplified. In addition, signal generation processing of the first decoding unit U12 and signal generation processing of the second decoding unit U32 can be also simplified. Accordingly, the present embodiment can provide an acoustic simulation apparatus that simplifies signal processing.

Here, the terms of "first" and "second" are used for distinguishing the component included in a plurality of components when similar components exist. Thus, these terms do not mean the order.

The B-format signal of Ambisonics and other signals can be used as the first encoded signal and the second encoded signal.

Note that the above described remarks can be also applied to the following embodiments.

Embodiment 3

The number Np of setting positions of the virtual speakers VS0 may be larger than the number Ns of installation positions of the speakers 300. The present embodiment can provide an acoustic simulation apparatus that simulates the stereophonic sound in the compartment of the vehicle more precisely.

Embodiment 4

As illustrated in FIGS. 3 and 4, the acoustic simulation apparatus 1 may further include a virtual speaker setting position reception unit U4 configured to receive setting positions of the virtual speakers VS0. The present embodiment can provide an acoustic simulation apparatus that makes it easy to simulate the stereophonic sound in the compartment in accordance with the vehicle.

In addition, the present technology can be applied to a composite device including the acoustic simulation apparatus, an acoustic simulation method, a control method of the composite device, an acoustic simulation program, a control program of the composite device, a computer-readable medium storing the acoustic simulation program, the control program, and the like. The acoustic simulation apparatus and the composite device may be composed of a plurality of distributed parts.

(2) Concrete Example of Acoustic Simulation Apparatus

FIG. 1 schematically illustrates an interior 110 of an automobile 100 in which ambisonic microphones AM0 are installed in a state that an illustration of a side surface part is omitted. An enlarged view of the ambisonic microphone AM0 is shown at a lower part of FIG. 1. The ambisonic microphone AM0 is a generic term of ambisonic microphones AM1, AM2. In FIG. 1, FRONT, REAR, UP and DOWN respectively represent the front, rear, up and down. Positional relation of the left and right is based on a direction of viewing the front from the rear of the automobile 100. In addition, the Z-direction indicates the front-back direction of the automobile 100, and the X-direction indicates the up-down direction of the automobile 100. Of course, the explanation of the positional relation of each part is merely an example.

The automobile 100 shown in FIG. 1 is a road vehicle designed and equipped for running on the road. For example, vehicle body panels made of metal such as steel plate surround a vehicle compartment SP1 and a luggage compartment SP2 to form a vehicle body. The automobile to which the present technology can be applied is not limited to the automobiles such as a station wagon and the like where the vehicle compartment SP1 and the luggage compartment SP2 are communicated with each other. The present technology can be also applied to the automobiles such as a sedan and the like where the vehicle compartment SP1 and the luggage compartment SP2 are separated from each other. Note that the vehicle compartment SP1 and the luggage compartment SP2 are generically called a compartment SP0.

Various interior materials such as interior materials 111 to 116 are arranged on a vehicle body panel of the automobile 100 at the compartment SP0 side. A floor carpet 111 facing the vehicle compartment SP1 is installed on a floor panel (example of the vehicle body panel) located below the vehicle compartment SP1. A door trim 112 facing the vehicle compartment SP1 is installed on a door panel (example of the vehicle body panel) also located on the left and right sides of the vehicle compartment SP1. A pillar trim 113 facing the vehicle compartment SP1 is installed on a pillar (example of the vehicle body panel) located on the left and right sides of the vehicle compartment SP1. The pillar trim is also called a pillar garnish. A roof trim 114 facing the vehicle compartment SP1 and the luggage compartment SP2 is installed on a roof panel (example of the vehicle body panel) located above the vehicle compartment SP1 and the luggage compartment SP2. A deck side trim 115 facing the luggage compartment SP2 is installed on a deck side panel (example of the vehicle body panel) located on the left and right sides of the luggage compartment SP2. An interior material 116 of an instrument panel facing the vehicle compartment SP1 is installed on the instrument panel (example of the vehicle body panel) located in front of the vehicle compartment SP1.

A front seat 101 which is a generic term of a driver's seat and a front passenger seat is arranged in the vehicle compartment SP1. A rear seat 102 arranged behind the front seat 101 is arranged on the vehicle compartment SP1. The ambisonic microphone AM1 is arranged at the position matched (adjusted) to the position of the head of the driver sitting on the driver's seat. The ambisonic microphone AM2 is arranged at the position matched (adjusted) to the position of the head of the passenger sitting on the rear seat 102 arranged behind the driver's seat. The position of the ambisonic microphone AM1 is a listening position 120 of the driver sitting on the driver's seat. The position of the ambisonic microphone AM2 is the listening position 120 of the passenger sitting on the rear seat 102 arranged behind the driver's seat. Of course, the ambisonic microphone AM1 may be arranged on the position matched to the position of the head of the passenger sitting on the front passenger seat and the ambisonic microphone AM2 may be arranged on the position of the head of the passenger sitting on the rear seat 102 arranged behind the front passenger seat.

As shown in the lower part of FIG. 1, the ambisonic microphone AM0 includes four microphone capsules AMc which are directed outward with respect to each surface of the regular tetrahedron. Each of the capsules AMc converts the sound propagated in the air into an electric signal. The ambisonic microphone AM0 converts the electric signal input from each of the capsules AMc into individual sound pickup signals M1 to M4 (shown in FIG. 3) which are in digital format. As illustrated in FIG. 3, the individual sound pickup signals M1 to M4 are generically called a sound pickup signal SG1. The sound pickup signal SG1 is a digital electric signal obtained by picking up the sound from four directions. The sound pickup signal SG1 is the sound pickup signal of the stereophonic sound at the listening position 120 in the compartment SP0.

Figure 2:
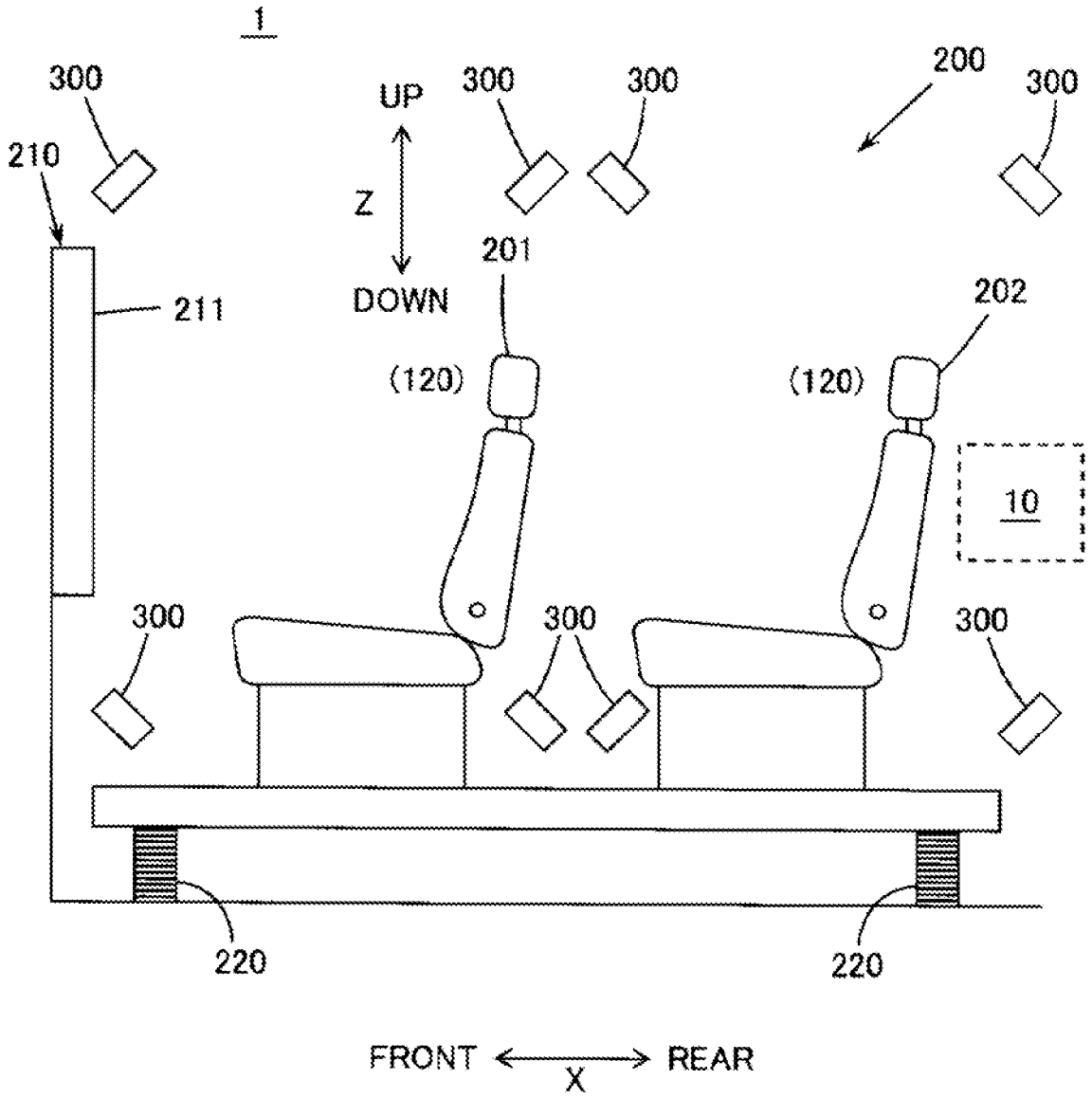
FIG. 2 is a drawing schematically showing an example of an acoustic simulation apparatus.

FIG. 2 schematically illustrates the acoustic simulation apparatus 1 including a simulated automobile 200. The simulated automobile 200 includes a front seat 201 which corresponds to the front seat 101 of the automobile 100 and a rear seat 202 which corresponds to the rear seat 102 of the automobile 100. The acoustic simulation apparatus 1 includes sixteen speakers 300. The sixteen speakers 300 include eight speakers 300 for reproducing the stereophonic sound at the listening position 120 of the front seat 201 and eight speakers 300 for reproducing the stereophonic sound at the listening position 120 of the rear seat 202. For the convenience of the illustration, only four speakers 300 for the front seat 201 and only four speakers 300 for the rear seat 202 are shown. The eight speakers 300 for the front seat 201 are arranged on the upper left of the front side, the upper right of the front side, the upper left of the rear side, the upper right of the rear side, the lower left of the front side, the lower right of the front side, the lower left of the rear side and the lower right of the rear side when viewed from the listening position 120 of the front seat 201. The eight speakers 300 for the rear seat 202 are also arranged on the upper left of the front side, the upper right of the front side, the upper left of the rear side, the upper right of the rear side, the lower left of the front side, the lower right of the front side, the lower left of the rear side and the lower right of the rear side when viewed from the listening position 120 of the rear seat 202.

The acoustic simulation apparatus 1 further includes a video display device 210 having a curved surface display 211 arranged from the front to both left and right sides viewed from the front seat 201, a vibration device 220 arranged below the seats 201, 202, and a controller 10. The video display device 210 displays the video on the display 211 as if the automobile travels virtually. The vibration device 220 applies vibration to the seats 201, 202 in the Z-direction as if the automobile travels virtually. The controller 10 makes a plurality of speakers 300 output the stereophonic sound as if the automobile travels virtually, makes the video display device 210 display the video as if the automobile travels virtually, and makes the vibration device 220 generate the vibration in the Z-direction as if the automobile travels virtually. The controller 10 synchronizes the output of the stereophonic sound outputted from the speakers 300, the display of the video displayed by the video display device 210 and the output of the vibration outputted by the vibration device 220. Since the video and the vibration when the automobile travels are reproduced simultaneously with the stereophonic sound, the user of the acoustic simulation apparatus 1 can obtain the feeling with an excellent feeling of presence.

FIG. 3 schematically illustrates the signal processing of the acoustic simulation apparatus 1. The signal processing is performed independently between the individual sound pickup signals M1 to M4 obtained from the ambisonic microphone AM1 for the front seat 101 and the individual sound pickup signals M1 to M4 obtained from the ambisonic microphone AM2 for the rear seat 102. In this concrete example, the number Ns (integer number) of installation positions of the speakers 300 is 8 (eight). The individual output signals S1 to SNs obtained by the signal processing for the front seat 101 are outputted to eight speakers 300 for the front seat 201. The individual output signals S1 to SNs obtained by the signal processing for the rear seat 102 are outputted to eight speakers 300 for the rear seat 202. As illustrated in FIG. 3, the individual output signals S1 to SNs are generically called an output signal SG6.

The acoustic simulation apparatus 1 shown in FIG. 3 includes the virtual reproduction signal generation unit U1, the virtual prediction signal generation unit U2, the output signal generation unit U3 and the virtual speaker setting position reception unit U4 for generating the output signal SG6 from the sound pickup signal SG1. The output signal SG6 is the signal for causing a plurality of speakers 300 to output the simulated stereophonic sound. The virtual reproduction signal generation unit U1 includes the first format converting unit U11 for converting the sound pickup signal SG1 into the first encoded signal SG2 and the first decoding unit U12 for converting the first encoded signal SG2 into the virtual reproduction signal SG3. The virtual prediction signal generation unit U2 generates the virtual prediction signal SG4 based on the virtual reproduction signal SG3 and acoustic characteristic change information IM1. The output signal generation unit U3 includes the second format converting unit U31 for converting the virtual prediction signal SG4 into the second encoded signal SG5 and the second decoding unit U32 for converting the second encoded signal SG5 into the output signal SG6. The acoustic simulation apparatus 1 shown in FIG. 3 uses Ambisonics. The format converting units U11, U31 convert the A-format signal into the B-format signal. The virtual prediction signal generation unit U2 converts the virtual reproduction signal SG3 into the virtual prediction signal SG4 which is the A-format signal, the virtual reproduction signal SG3 being assigned to the virtual speakers VS0 of the Np positions on the basis of the first encoded signal SG2 which is the B-format signal. For this reason, the stereophonic sound in the compartment SP0 can be simulated precisely.

First, a configuration example of the controller 10 of the acoustic simulation apparatus 1 will be explained with reference to FIG. 4. FIG. 4 schematically illustrates the configuration of the controller 10 with a peripheral part.

The controller 10 includes a CPU (Central Processing Unit) 11 which is a processor, a ROM (Read Only Memory) 12 which is a semiconductor memory, a RAM (Random Access Memory) 13 which is a semiconductor memory, a timer 14, a storage device 15, an input device 16, an output device 17, an I/F (interface) 18, and the like. The components 11 to 18 are connected with each other so that the information can be mutually inputted and outputted. The storage device 15 stores an operating system, an acoustic simulation program, sound pickup signals SG1, first encoded signals SG2, acoustic characteristic change information IM1, and the like. The CPU 11 executes the operating system and the acoustic simulation program while the RANI 13 is used as a work area. Thus, the CPU 11 makes a computer function as the controller 10 having the virtual reproduction signal generation unit U1, the virtual prediction signal generation unit U2, the output signal generation unit U3 and the virtual speaker setting position reception unit U4. Consequently, the controller 10 controls the operations of the acoustic simulation apparatus 1 to execute the acoustic simulation method. The storage device 15 functions as computer-readable medium storing the acoustic simulation program for making the computer function as the acoustic simulation apparatus 1.

The input device 16 receives various inputs such as setting positions of the virtual speakers VS0. A pointing device, a keyboard, a touch panel and the like can be used as the input device 16. The output device 17 receives various outputs such as a display of the setting positions of the virtual speakers VS0. A display device such as a liquid crystal display, a sound output device, a printer and the like can be used as the output device 17. The I/F 18 performs communication with peripheral devices. For example, the I/F 18 performs the input of the sound pickup signal SG1 from the ambisonic microphone AM0, the output of the output signal SG6 to a plurality of speakers 300, the output of the video signal to the video display device 210, the output of the drive signal to the vibration device 220, and the like. Note that it is not necessary to connect the controller 10 with the ambisonic microphones AM0 when simulating the sound since the sound pickup signal SG1 obtained by the ambisonic microphones AM0 is stored in the storage device 15.

Referring to FIG. 3, the signal processing of the acoustic simulation apparatus 1 will be explained in detail. As described above, since the signal processing for the front seat 101 and the signal processing for the rear seat 102 are independently performed, the explanation will be made by using the example of the signal processing for the front seat 101.

The sound pickup signal SG1 is the A-format signal obtained by picking up the stereophonic sound at the listening position 120 matched to the position of the head of the passenger sitting on the front seat 101. Since the number Nm of the capsules AMc of the ambisonic microphone AM1 is four, the number of the individual sound pickup signals Mi constituting the sound pickup signal SG1 is four. Here, the variable i is a variable for identifying the individual sound pickup signals. The variable i can be an integral from 1 to Nm. Note that the number Nm is not limited to four. The number Nm may be five or more. The first format converting unit U11 converts the sound pickup signal SG1 having the A-format into the first encoded signal SG2 having a plurality of sound pickup directivity characteristics (components W, X, Y, Z) and stores the first encoded signal SG2 in the storage device 15. As long as the sound pickup signal SG1 is not changed, it is possible to perform the process of generating the output signal SG6 from the first encoded signal SG2.

The first encoded signal SG2 is the B-format signal including a nondirectional zero-order component W, a primary component X of the front-back direction, a primary component Y of the left-right direction and a primary component Z of the up-down direction. Here, the primary component X corresponds to the X-direction in FIGS. 1 and 2, and the primary component Z corresponds to the Z-direction in FIGS. 1 and 2. The individual sound pickup signals Mi can be converted into the components W, X, Y, Z of the first encoded signal SG2 by using a conventionally known conversion formula. For example, the conversion formulas converting the signal $L_F$ obtained by the microphone capsule directed in the upper direction of the front left, the signal $L_B$ obtained by the microphone capsule directed in the lower direction of the rear left, the signal $R_F$ obtained by the microphone capsule directed in the lower direction of the front right, and the signal $R_B$ obtained by the microphone capsule directed in the lower direction of the rear right into the components X, Y, Z and W of the B-format signal are shown in Ryouichi NISHIMURA, "Ambisonics", The Journal of The Institute of Image Information and Television Engineers, The Institute of Image Information and Television Engineers, August 2014, Vol. 68, No. 8, p. 616-620.

$$X=L_F-R_B+R_F-L_B \tag{1}$$

$$Y=L_F-R_B-R_F+L_B \tag{2}$$

$$Z=L_F-L_B+R_B-R_F \tag{3}$$

$$W=L_B-L_F+R_F-R_B \tag{4}$$

When the directions of the four microphone capsules AMc shown in FIG. 1 are the above described directions, the individual sound pickup signals M1 to M4 can be converted into the components W, X, Y, Z by using the conversion formulas (1) to (4).

The first decoding unit U12 generates the virtual reproduction signal SG3 based on the first encoded signal SG2 at the listening position 120, assuming that the virtual speakers VS0 are respectively located at the portions of the Np positions in the automobile 100, the virtual reproduction signal causing the virtual speakers VS0 of the Np positions to reproduce the stereophonic sound. The setting positions of the virtual speakers VS0 are portions of the interior 110 such as the interior materials 111 to 116 shown in FIG. 1. In addition, the virtual speakers VS0 may be respectively set on different portions in each of the interior materials 111 to 116. For example, the virtual speakers VS0 can be respectively set on different positions in the floor carpet 111. The number of the individual virtual reproduction signals Pj constituting the virtual reproduction signal SG3 is Np. Here, the variable j is a variable for identifying the individual virtual reproduction signals P1 to PNp. The variable j can be an integral from 1 to Np. The number Np of the setting positions of the virtual speakers VS0 can be two or more. However, from the viewpoint of simulating the stereophonic sound in the compartment SP0 precisely, the number Np is preferably four or more. More preferably, the number Np is larger than the number Nm of the individual sound pickup signal Mi. Further more preferably, the number Np is more than the number Ns of the installation positions of the actual speakers 300. The setting positions of the virtual speakers VS0 of the Np positions are preferably not located on the same plane.

The setting positions of the virtual speakers VS0 of the Np positions on the simulated automobile 200 can be changed by the virtual speaker setting position reception unit U4. The virtual speaker setting position reception unit U4 displays the screen displaying the simulated automobile together with the listening position 120 on the output device 17 such as a display device. The virtual speaker setting position reception unit U4 receives the setting positions of the virtual speakers VS0 by receiving the operation of the input device 16 such as a pointing device on the display. Consequently, the stereophonic sound can be simulated easily in accordance with the compartment SP0 of the vehicle. The virtual speaker setting position reception unit U4 can receive two or more setting positions of the virtual speakers VS0, more preferably four or more positions, and further more preferably more than the Ns positions.

The components W, X, Y, Z of the first encoded signal SG2 can be converted into the individual virtual reproduction signals Pj by the conversion formula depending on the vectors from the setting position of each of the virtual speakers VS0 to the listening position 120.

$$Pj=wj*W+xj*X+yj*Y+zj*Z \tag{5}$$

Here, the coefficients wj, xj, yj, zj for the components W, X, Y, Z are the values depending on the vectors from the setting position of the virtual speakers VS0 corresponding to the variable j to the listening position 120.

For a reference, it is assumed that the listening position 120 is located at the center of a virtual cube and the virtual speakers VS0 are respectively installed on the apexes of the upper left of the front side, the upper right of the front side, the upper left of the rear side, the upper right of the rear side, the lower left of the front side, the lower right of the front side, the lower left of the rear side and the lower right of the rear side when viewed from the listening position 120 of the virtual cube. When the individual virtual reproduction signals assigned to each of the virtual speakers VS0 are expressed as $L_{FU}$, $R_{FU}$, $L_{BU}$, $R_{BU}$, $L_{FD}$, $R_{FD}$, $L_{BD}$, $R_{BD}$, the conversion formulas shown in "Ambisonics" which is the above described document can be applied.

$$L_{FU}=W+0.707(X+Y+Z) \tag{6}$$

$$R_{FU}=W+0.707(X-Y+Z) \tag{7}$$

$$L_{BU}=W+0.707(-X+Y+Z) \tag{8}$$

$$R_{BU}=W+0.707(-X-Y+Z) \tag{9}$$

$$L_{FD}=W+0.707(X+Y-Z) \tag{10}$$

$$R_{FD}=W+0.707(X-Y-Z) \tag{11}$$

$$L_{BD}=W+0.707(-X+Y-Z) \tag{12}$$

$$R_{BD}=W+0.707(-X-Y-Z) \tag{13}$$

The virtual prediction signal generation unit U2 generates the virtual prediction signal SG4 based on the virtual reproduction signal SG3 and the acoustic characteristic change information IM1, the virtual prediction signal SG4 causing the virtual speakers VS0 of the Np positions to output a prediction sound predicted at the listening position 120. The acoustic characteristic change information IM1 is the information representing the change of the acoustic characteristics when at least a part of the portions of the Np positions of the automobile 100 is changed. The acoustic characteristic change information IM1 can be obtained by a computer simulation, for example. As shown in FIG. 3, the acoustic characteristics of each of the portions can be represented by the data representing the corresponding relation between the frequency f (unit: Hz) and the SPL (sound pressure level) (unit: dB). For example, the acoustic characteristics of each position are represented by the data representing the SPL with respect to the frequency zone of each ⅓ octave band. It can be said that the acoustic characteristic change information IM1 is the information representing the difference from the basic specification. It can be also said that the acoustic characteristic change information IM1 is the information representing how much the sound pressure of each frequency is increased or decreased from the basic specification in the direction of each of the portions with respect to the head of the passenger.

The virtual prediction signal generation unit U2 can perform an analysis by a computer simulation when the specification of the interior materials or the like in the automobile is changed.

The virtual prediction signal generation unit U2 predicts the difference from the basic specification about the stereophonic sound. The virtual prediction signal generation unit U2 has vehicle models representing the structure of the compartment SP0. For example, the structure of the compartment SP0 can be the data representing the positions of the members such as the interior materials and the seats in the automobile, the shapes of the members, and the like. In addition, the virtual prediction signal generation unit U2 has actual vehicle database representing the acoustic characteristics obtained when the automobile 100 is traveled in various conditions. Furthermore, the virtual prediction signal generation unit U2 has member database representing characteristics related to the sounds such as the characteristics of sound absorption rate, the characteristics of sound reflectance, flow resistance, loss factor, and the like of each member of the automobile. Here, above described members include plural types of members applicable to the same portion. For example, the members include plural types of members applicable to the floor carpet 111. The virtual prediction signal generation unit U2 can calculate the acoustic characteristic change information IM1 by a computer simulation where the combination of the data desired by the user is applied to the vehicle model from the data stored in the actual vehicle database and the member database.

As a simple example, the virtual prediction signal generation unit U2 may acquire the data representing acoustic characteristics CH0 of the portions of the Np positions when the automobile 100 is traveled under a certain condition, acquire the data representing acoustic characteristics CH1 of the portions of the Np positions when the automobile 100 is traveled in a state that a certain member is changed to a different type of member, and calculate the acoustic characteristic change information IM1 of the portions of the Np positions from the difference between the acoustic characteristics CH0, CH1. A large amount of acoustic characteristic change information IM1 can be calculated by calculating the acoustic characteristic change information when only the type of the floor carpet 111 is changed, the acoustic characteristic change information when only the type of the door trim 112 is changed, and the like. As a simple example, it is possible to calculate the acoustic characteristic change information IM1 about the only portion where a type of the member is changed, and it may be managed as the acoustic characteristics are not changed about the portion where a type of the member is not changed.

The virtual prediction signal generation unit U2 can receive the change of the type of the each member of the interior 110 such as the interior materials 111 to 116. The virtual prediction signal generation unit U2 displays the screen showing the simulated automobile on the output device 17 such as a display device, and receives the selection of the member and the change of the type of the member by receiving the operation of the input device 16 such as a pointing device on the display. The virtual prediction signal generation unit U2 calculates the acoustic characteristic change information IM1 of each of the portions by the computer simulation where the data representing the acoustic characteristics of the selected member before the change and the acoustic characteristics of the selected member after the change are applied to the vehicle model from the data stored in the actual vehicle database and the member database. Consequently, the simulation of the sound is performed according to various requests of the user.

For example, supposing that the user made an operation of selecting the floor carpet 111 on the above described screen by the input device 16 and then the user made an operation of changing the type of the floor carpet 111 from the original type (referred to as type C0) to the other type (referred to as type C1) by the input device 16. In this case, the virtual prediction signal generation unit U2 calculates the acoustic characteristic change information IM1 representing the difference between the acoustic characteristics CH0 where the floor carpet 111 is the original type C0 and the acoustic characteristics CH1 where the floor carpet 111 is the other type C1 about each of the portions.

The number of the individual virtual prediction signals Qj constituting the virtual prediction signal SG4 generated based on the virtual reproduction signal SG3 and the acoustic characteristic change information IM1 is also Np. Namely, the variable j, which can be an integral from 1 to Np, is also the variable for identifying the individual virtual prediction signals Q1 to QNp. The individual virtual prediction signals Qj is the signal changed from the original individual virtual reproduction signals Pj according to the acoustic characteristic change information IM1. As a simple example, the virtual prediction signal generation unit U2 may generate the signal changed from the original individual virtual reproduction signals Pj according to the acoustic characteristic change information IM1 for the individual virtual prediction signals Qj for causing the virtual speakers VS0 to output the prediction sound only for the virtual speakers VS0 located at the portion where the change of the type of the member is received. In this case, the individual virtual prediction signals Qj for causing the virtual speakers VS0 located at the portion where the type of the member is not changed to output the prediction sound may be the original individual virtual reproduction signals Pj.

It can be said that the virtual prediction signal SG4 for causing the virtual speakers VS0 of the Np positions to output the prediction sound is the A-format signal corresponding to the prediction sound at the listening position 120 matched to the position of the head of the passenger sitting on the front seat 101. The second format converting unit U31 converts the virtual prediction signal SG4 which is the A-format signal into the second encoded signals SG5 having a plurality of sound pickup directivity characteristics (components W, X, Y, Z).

The second encoded signal SG5 is also the B-format signal including a nondirectional zero-order component W, a primary component X of the front-back direction, a primary component Y of the left-right direction and a primary component Z of the up-down direction. The individual virtual prediction signals Q1 to QNp can be converted into the components W, X, Y, Z of the second encoded signal SG5 by using the conversion formula depending on the vectors from the setting position of each of the virtual speakers VS0 to the listening position 120.

[Formula 1]

$$X = \sum_{j=1}^{Np} (qxj \cdot Qj) \tag{14}$$

$$Y = \sum_{j=1}^{Np} (qyj \cdot Qj) \tag{15}$$

$$Z = \sum_{j=1}^{Np} (qzj \cdot Qj) \tag{16}$$

$$W = \sum_{j=1}^{Np} (qwj \cdot Qj) \tag{17}$$

Here, the coefficients qxj, qyj, qzj, qwj for the individual virtual prediction signals Qj are the values depending on the vectors from the setting position of the virtual speakers VS0 corresponding to the variable j to the listening position 120.

The second decoding unit U32 generates the output signal SG6 based on the second encoded signal SG5, the output signal SG6 causing the speakers 300 of the Ns positions to output the prediction sound. The number of the individual output signals Sk constituting the output signal SG6 is Ns. Here, the variable k is a variable for identifying the individual output signals S1 to SNs. The variable k can be an integral from 1 to Ns. The number Ns of the speakers 300 is preferably four or more from the viewpoint of outputting the stereophonic prediction sound precisely. The installation positions of the Ns speakers 300 are preferably not located on the same plane.

The components W, X, Y, Z of the second encoded signal SG5 can be converted into the individual output signals S1 to SNs by using the conversion formula depending on the vectors from the installation position of each of the speakers 300 to the listening position 120.

$$Sk=wk*W+xk*X+yk*Y+zk*Z \quad (18)$$

Here, the coefficients wk, xk, yk, zk for the components W, X, Y, Z are the values depending on the vectors from the installation position of the speakers 300 corresponding to the variable k to the listening position 120.

For a reference, it is assumed that the listening position 120 is located at the center of a virtual cube and the speakers 300 are respectively installed on the apexes of the upper left of the front side, the upper right of the front side, the upper left of the rear side, the upper right of the rear side, the lower left of the front side, the lower right of the front side, the lower left of the rear side and the lower right of the rear side when viewed from the listening position 120 of the virtual cube. When the individual output signals assigned to each of the speakers 300 are expressed as $L_{FU}$, $R_{FU}$, $L_{BU}$, $R_{BU}$, $L_{FD}$, $R_{FD}$, $L_{BD}$, $R_{BD}$, the conversion formulas shown in "Ambisonics" which is the above described document can be applied.

$$L_{FU}=W+0.707(X+Y+Z) \quad (19)$$

$$R_{FU}=W+0.707(X-Y+Z) \quad (20)$$

$$L_{BU}=W+0.707(-X+Y+Z) \quad (21)$$

$$R_{BU}=W+0.707(-X-Y+Z) \quad (22)$$

$$L_{FD}=W+0.707(X+Y-Z) \quad (23)$$

$$R_{FD}=W+0.707(X-Y-Z) \quad (24)$$

$$L_{BD}=W+0.707(-X+Y-Z) \quad (25)$$

$$R_{BD}=W+0.707(-X-Y-Z) \quad (26)$$

Although the signal processing for the front seat 101 is explained above, the signal processing for the rear seat 102 is performed same as the above described signal processing.

In the above described concrete example, the individual virtual reproduction signals P1 to PNp are generated based on the first encoded signal SG2 having the components W, X, Y, Z of the B-format are generated first, the individual virtual reproduction signals P1 to PNp causing the virtual speakers VS0 of the Np positions to reproduce the stereophonic sound. The individual virtual reproduction signals P1 to PNp constituting the virtual reproduction signal SG3 are converted into the individual virtual prediction signals Q1 to QNp based on the acoustic characteristic change information IM1 representing the change of the acoustic characteristics when at least a part of the portions of the Np positions is changed. The individual virtual prediction signals Q1 to QNp constituting the virtual prediction signal SG4 are converted into the individual output signals S1 to SNs via the second encoded signal SG5 having the components W, X, Y, Z of the B-format, the virtual prediction signal SG4 causing the speakers 300 of the Ns positions to output the prediction sound. The individual output signals S1 to SNs constituting the output signal SG6 make the speakers 300 of the Ns positions output the prediction sound to which the change of the acoustic characteristics are precisely reflected when at least a part of the portions of the Np positions is changed.

As described above, the change of the sound outputted from the setting positions corresponding to the virtual speakers VS0 of the Np positions is predicted by the computer simulation or the like, and the stereophonic prediction sound is outputted from the speakers 300 of the Ns positions. Consequently, the user can feel the prediction result predicted by the computer simulation or the like at the listening position 120 as the stereophonic sound with an excellent feeling of presence. Accordingly, the user can develop the members quickly based on the prediction sound or the output signal SG6 without actually producing or assembling the member of the automobile. In addition, since the user can listen to the prediction sound repeatedly, the user can easily notice small changes although it is difficult to judge such small changes by sensory evaluation using the actual automobile.

(3) Variation Example

Various variation examples of the present invention are conceivable.

In the concrete examples described above, signal processing of two systems are performed for the signal processing of the front seat and the signal processing of the rear seat. Alternatively, it is also possible to perform the signal processing of the driver's seat separately from the signal processing of the front passenger seat for the front seat, for example. In this case, the acoustic simulation apparatus may include the speakers 300 of the Ns positions for the driver's seat and the speakers 300 of the Ns positions for the front passenger seat. Also for the rear seat, it is possible to perform the signal processing for the seat arranged behind the driver's seat separately from the signal processing for the seat arranged behind the front passenger seat. Of course, the acoustic simulation apparatus may perform the signal processing only for the front seat or the acoustic simulation apparatus may perform the signal processing only for the rear seat The process of generating the virtual reproduction signal SG3 from the sound pickup signal SG1 is not limited to the process of interposing the first encoded signal SG2 having the B-format between them. For example, the virtual reproduction signal SG3 can be directly generated from the sound pickup signal SG1 by using the conversion formula converting the individual sound pickup signals M1 to M4 into the individual virtual reproduction signals P1 to PNp.

The process of generating the output signal SG6 from the virtual prediction signal SG4 is not limited to the process of interposing the second encoded signal SG5 having the B-format between them. For example, the output signal SG6 can be directly generated from the virtual prediction signal SG4 by using the conversion formula converting the individual virtual prediction signals Q1 to QNp into the individual output signals S1 to SNs.

(4) Conclusion

As explained above, various embodiments of the present invention can provide a technology of the acoustic simulation apparatus and the like that is capable of simulating the stereophonic sound in the compartment of the vehicle precisely. Of course, the above-described basic operation and effect can be obtained even with only the components described in the independent claims.

The present invention can be also implemented by replacing the features disclosed in the above-described examples with each other or changing the combinations thereof, and the present invention can be also implemented by replacing the conventional features and the features disclosed in the above-described examples with each other or changing the combinations thereof. The present invention includes these features and the like.

What is claimed is:

1. An acoustic simulation apparatus for simulating a sound in a compartment of a vehicle, the acoustic simulation apparatus comprising:

a virtual reproduction signal generation unit configured to generate a virtual reproduction signal based on a sound pickup signal of a stereophonic sound at a listening position in the compartment, assuming that virtual speakers are respectively located at portions of Np positions which are two or more positions in the vehicle, the virtual reproduction signal causing the virtual speakers of the Np positions to reproduce the stereophonic sound;

a virtual prediction signal generation unit configured to generate a virtual prediction signal based on the virtual reproduction signal and an information representing a change of acoustic characteristics when at least a part of the portions of the Np positions is changed, the virtual prediction signal causing the virtual speakers of the Np positions to output a predicted sound at the listening position; and an output signal generation unit configured to generate an output signal based on the virtual prediction signal, the output signal causing speakers of a plurality of positions to output the predicted sound.

2. The acoustic simulation apparatus according to claim 1, wherein the virtual reproduction signal generation unit includes:

a first format converting unit configured to convert the sound pickup signal into a first encoded signal having a plurality of sound pickup directivity characteristics; and a first decoding unit configured to generate the virtual reproduction signal based on the first encoded signal, and the output signal generation unit includes:

a second format converting unit configured to convert the virtual prediction signal into a second encoded signal having the plurality of sound pickup directivity characteristics; and a second decoding unit configured to generate the output signal based on the second encoded signal.

3. The acoustic simulation apparatus according to claim 1, wherein the number Np of setting positions of the virtual speakers is larger than the number of installation positions of the speakers.

4. The acoustic simulation apparatus according to claim 1, further comprising:

a virtual speaker setting position reception unit configured to receive setting positions of the virtual speakers.

* * * * *